US006612296B1

(12) United States Patent
Yonezawa et al.

(10) Patent No.: US 6,612,296 B1
(45) Date of Patent: Sep. 2, 2003

(54) CONTROL APPARATUS FOR INTERNAL COMBUSTION ENGINE

(75) Inventors: Shiro Yonezawa, Tokyo (JP); Tomokazu Makino, Tokyo (JP); Eiji Kanazawa, Tokyo (JP); Takou Watanuki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/352,916

(22) Filed: Jan. 29, 2003

(30) Foreign Application Priority Data

Jul. 10, 2002 (JP) ..... 2002-201290

(51) Int. Cl.[7] ..... F02P 9/00
(52) U.S. Cl. ..... 123/612; 123/613; 123/179.1
(58) Field of Search ..... 123/612, 617, 123/613, 594, 179.1

(56) References Cited

U.S. PATENT DOCUMENTS 5,044,336 A * 9/1991 Fukui ..... 123/406.53

FOREIGN PATENT DOCUMENTS

JP 2002-130036 5/2002

* cited by examiner

*Primary Examiner*—Bibhu Mohanty
(74) *Attorney, Agent, or Firm*—Sughrue Mion, PLLC

(57) ABSTRACT

An engine control apparatus for preventing erroneous cylinder identification by clearing cylinder identification information upon detection of on/off operation of a starter (50) includes a sensor (32) for generating crank angle pulse signals with dropout portions corresponding to reference positions defined by tooth dropout sections provided in an angular position detecting member (31), a sensor (22) for generating cylinder identifying pulse signals, an electronic control unit (40) for identifying cylinders of the engine (10) and crank angle positions on the basis of sensor output signals. The electronic control unit (40) includes means for detecting changeover of driving/non-driving states of the starter (50), means for detecting an engine rotation speed (NE), and cylinder identification information invalidating means responsive for changeover of the starter driving states in an engine starting operation to inhibit the information from being employed in succeeding cylinder identification.

6 Claims, 8 Drawing Sheets

CONTROL APPARATUS FOR INTERNAL COMBUSTION ENGINE

BACKGROUND OF THE INVENTION

1. Field of the Invention

The present invention generally relates to a control apparatus for an internal combustion engine (hereinafter also referred to simply as the engine) which apparatus is designed for performing identification of cylinders of the engine and control thereof on the basis of crank angle pulse signals related to a crank shaft of the engine mounted on a motor vehicle and cylinder identifying pulse signals related to a cam shaft of the engine. More particularly, the present invention relates to a control apparatus for an internal combustion engine in which the crank angle pulse signal contains unequi-interpulse intervals in correspondence to reference crank angle positions (hereinafter also referred to simply as the reference positions) in a pulse train composed of a large number of equi-interval pulses.

In particular, the present invention is concerned with a control apparatus for the internal combustion engine which apparatus is so designed as to prevent erroneous ignition and fuel injection controls ascribable to erroneous identification of the reference positions and the cylinders which may be brought about by repetitive on/off manipulation of a cranking switch (hereinafter also referred to as the starter switch) in the course of an engine starting operation.

2. Description of Related Art

In general, in the internal combustion engine such as the engine for an automobile or a motor vehicle, it is required to detect on a cylinder-by-cylinder basis the crank angle positions corresponding to rotational positions of the engine in order to control optimally the fuel injection timing as well as the ignition timing for a plurality of engine cylinders in dependence on the engine operation state or condition.

Such being the circumstances, in the conventional control apparatuses for the internal combustion engine known heretofore, electromagnetic sensors are provided in association with a crank shaft and a cam shaft, respectively, of the engine to thereby make available the crank angle pulse signals (also referred to as the crank angle pulses) indicating reference positions for the individual cylinders, respectively, and cam signals (also referred to as the cylinder identifying pulse signals or simply as the cylinder identifying pulses) for identifying discriminatively a specific cylinder and individual cylinders, respectively.

Further, a control unit (referred to as an electronic control unit or ECU in abbreviation) is provided which is so arranged as to discriminatively determine or identify the individual cylinders on the basis of the crank angle pulse signals and the cylinder identifying pulse signals while determining discriminatively the reference positions on a cylinder-by-cylinder basis to thereby arithmetically determine various control quantities for realizing the fuel injection control and the ignition timing control with high accuracy and reliability.

To this end, a crank angle position detecting means is provided which is composed of a disk which is rotatable in synchronism with the crank shaft and a crank angle sensor which is disposed in opposition to the disk. For generating the crank angle pulses which correspond to a plurality of crank angle positions, respectively, the disk is provided with a plurality of detecting members in the form of ring gear teeth with equidistance therebetween along the outer periphery of the disk.

The crank angle sensor is designed to generate as the output signal thereof the crank angle pulses at every predetermined angle (e. g. 10° in terms of the crank angle, represented hereinafter as 10° CA) upon every passing-by of the ring gear teeth (projections) formed in and along the outer peripheral edge of the disk rotating synchronously with the crank shaft.

Thus, the control unit can determine the reference positions (e.g. B75° CA (i.e., 75° CA before the top dead center or TDC) and B5° CA (i.e., 5° CA before the TDC) ) by detecting unequi-interpulse intervals in the crank angle pulse train by measuring the periodical intervals at which the crank angle pulses are generated.

To this end, the detecting member of the crank angle position detecting means is provided with a tooth dropout section (i.e., a peripheral portion in which no tooth is formed) which extends over an angular range of e.g. 30° CA at the reference position of each cylinder (e.g. position 75° or 5° CA before TDC in the compression stroke) so that the unequi-interpulse interval makes appearance in the train of the crank angle pulses generated at an equi-interpulse interval.

Further, the cam shaft which rotates at a ratio of 1/2 relative to the rotation of the crank shaft is provided with a crank angle position detecting means which is constituted by a disk rotatable in synchronism with the cam shaft and a cylinder identification sensor disposed in opposition to the disk. The cylinder identification sensor is so designed as to generate as the output signal thereof the cylinder identification information corresponding to the specific cylinder or individual cylinders.

In this manner, the control unit can detect the reference position corresponding to the partial pulse dropout portion or section (i.e., unequi-interpulse interval) in the crank angle pulse train to thereby realize the cylinder identification with high accuracy and reliability on the basis of combination of the crank angle pulses and the cylinder identifying pulses.

To say in another way, the control unit is capable of discriminatively identifying the individual cylinders on a real-time basis in response to the pulse dropout portions corresponding to the reference crank angle positions and the cylinder identifying pulse signals by detecting on a real-time basis the reference positions on the basis of the crank angle pulse signals.

In this conjunction, it is noted that the unequi-interpulse intervals (i.e., pulse dropout portions) in the crank angle pulse train can be detected correctly and relatively easily so long as the internal combustion engine rotates in the forward direction in a substantially steady state. However, in the course of the cranking operation carried out for starting the operation of the engine, there may arise such situation that the cranking operation is interrupted or stopped before the engine is actually put into operation (i.e., before the engine operation is started) because the starter is manipulated manually.

If the cranking operation should stop before the engine operation is started, then the driving torque is no more transmitted to the internal combustion engine from the starter. Consequently, the piston in the cylinder which is in the compression stroke would not completely be pushed up to the top dead center (TDC).

In that case, the piston may move downwardly from the crank angle position immediately before the TDC position, thus incurring possibly reverse rotation of the engine.

In this conjunction, it is noted that at the time point when the rotation of the internal combustion engine changes from the forward direction to the reverse direction (i.e., at the topmost position of the piston), the engine is caused to stop momentarily or transiently. As a result of this, the input period of the crank angle pulse will become longer. As a consequence, there may unwantedly arise such situation that the period detected at this time point is erroneously recognized as an unequi-interpulse interval or dropout portion (representing the reference position) in the crank angle pulse train.

Furthermore, in the case where the piston can barely clear the top dead center (TDC) in the compression stroke under inertia after the cranking operation has been stopped before the engine operation starts, the engine will then behave as if it stopped momentarily at the top dead center (TDC), which results in that the crank angle pulse period becomes longer at or around the top dead center (TDC) to such extent that the unequi-interpulse interval or dropout portion will erroneously be determined, giving rise to another problem.

Besides, in the case where the cranking operation is again started in the course of inertial rotation after stoppage of the cranking operation, the engine is driven again by the starter. In that case, since in the inertial rotation, the engine speed decreases gradually to zero, the crank angle pulse period becomes longer correspondingly. However, when the cranking operation is restarted, being driven by the starter, the engine rotation speed increases again, as a result of which the crank angle pulse period becomes shorter.

In this conjunction, it is however noted that when the engine rotation has reversed immediately before the cranking operation is started again, the engine stops temporarily upon transition from the reverse rotation to the forward rotation because the engine is forced to rotate in the forward direction when the cranking operation is restarted. Consequently, the crank angle pulse period will become longer to be erroneously detected as the unequi-interpulse interval or dropout portion.

As is apparent from the above, when the starter switch is repetitionally turned on and off (i.e., when the cranking operation is repetitively started and stopped) upon starting of the engine operation (i.e., before the engine is put into operation), the interval in which the crank angle pulse period becomes longer may make appearance to be erroneously detected as the unequi-interpulse interval or dropout portion.

If the unequi-interpulse interval (dropout portion) should erroneously be detected or identified by the electronic control unit as the reference position, then the detected crank angle position will become deviated from the actual position, which will then result in that the cylinder identification is performed with reference to the deviated crank angle position, incurring thus erroneous cylinder identification because of the deviation from the unequi-interpulse interval or dropout portion intrinsically dedicated for the identification of the cylinder.

Needless to say, when the crank angle position and the cylinder are detected and identified erroneously, the angular positions for controlling the fuel injection timing and the ignition timing will then differ from the normal or proper control positions. As a result of this, such undesired event as backfire, engine lock or the like may take place, damaging seriously the engine in the worst case.

As can now be appreciated from the foregoing, with the conventional control apparatus for the internal combustion engine, it is certainly possible to detect correctly the unequi-interpulse interval (corresponding to the tooth dropout section mentioned hereinbefore) without any appreciable difficulty so long as the engine rotates in the forward direction in the relatively stable state. However, when the cranking operation is repeated in the engine starting phase (i.e., before the engine is actually put into operation), the crank angle pulse period becomes unstable or nonuniform, as a result of which the unequi-interpulse interval may erroneously be detected, rendering it impossible to control the engine cylinder with sufficient accuracy and reliability, incurring undesirably occurrence of the backfire, engine lock or the like event which may eventually lead to serious damage of the engine, giving rise to problems.

SUMMARY OF THE INVENTION

In the light of the state of the art described above, it is an object of the present invention to provide a control apparatus for an internal combustion engine of a structure which is improved such that erroneous detection of the crank angle position and the cylinders can be prevented and thus erroneous control of the ignition and the fuel injection can positively be suppressed by detecting the driving/non-driving state of the starter and by inhibiting the cylinder identification information already acquired from being used in a succeeding cylinder identification process when the starter switch is turned on/off in the course of starting the operation of the engine.

Another object of the present invention is to provide a control apparatus for an internal combustion engine which can ensure enhanced reliability for the cylinder identification and the cylinder control by inhibiting the cylinder identification from being validated again until the normal rotational state of the engine can be detected.

In view of the above and other objects which will become apparent as the description proceeds, there is provided according to a general aspect of the present invention an improved control apparatus for an internal combustion engine.

The control apparatus includes a starter driven for rotation upon starting operation of an internal combustion engine, a crank shaft directly coupled to the internal combustion engine for corotation therewith, a crank shaft disk rotatable in synchronism with the crank shaft, angular position detecting members provided with equidistance therebetween along an outer peripheral edge of the crank shaft disk so as to correspond to a plurality of crank angle positions of the internal combustion engine, dropout sections for forming unequidistance portions partially in the angular position detecting members so as to correspond to reference crank angle positions, respectively, of cylinders of the internal combustion engine, a crank angle sensor disposed in opposition to the angular position detecting members for generating crank angle pulse signals representing the crank angle positions, a cam shaft rotatable at a rotation ratio of 1/2 relative to the crank shaft, a cam shaft disk rotatable in synchronism with the cam shaft, cylinder identification information detecting members provided along an outer periphery of the cam shaft disk so as to made available cylinder identification information of the internal combustion engine, a cylinder identifying sensor disposed in opposition to the cylinder identification information detecting members for generating cylinder identifying pulse signals representing the cylinder identification information, and an electronic control unit for controlling each of the cylinders of the internal combustion engine on the basis of the crank angle pulse signals and the cylinder identifying pulse signals.

The electronic control unit includes a cylinder identifying means for discriminatively identifying each of the cylinders of the internal combustion engine by making use of the crank angle position based on the crank angle pulse signals and the cylinder identification information based on the cylinder identifying pulse signals, a crank angle signal period arithmetic means for arithmetically determining input periods of the crank angle pulse signals as crank angle pulse signal periods, a starter drive detecting means for detecting changeover of driving state of the starter, a rotation speed detecting means for detecting rotation speed of the internal combustion engine, and a cylinder identification information invalidating means responsive to changeover of the starter driving state between driving state and non-driving state in an operation state in which the crank angle pulse signal period is longer than a predetermined period and in which rotation speed of the internal combustion engine is lower than a predetermined speed, for thereby invalidating the cylinder identification information detected before changeover of the starter driving state to inhibit the cylinder identification information from being employed in a succeeding cylinder identification.

By virtue of the arrangement of the control apparatus for the internal combustion engine described above, when the on/off operation of the starter switch is detected in the course of starting the operation of the engine, erroneous detection of the crank angle position and the cylinders can be prevented and thus erroneous control of the ignition and the fuel injection can positively be suppressed by inhibiting the cylinder identification information already detected from being employed in a succeeding cylinder identification.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
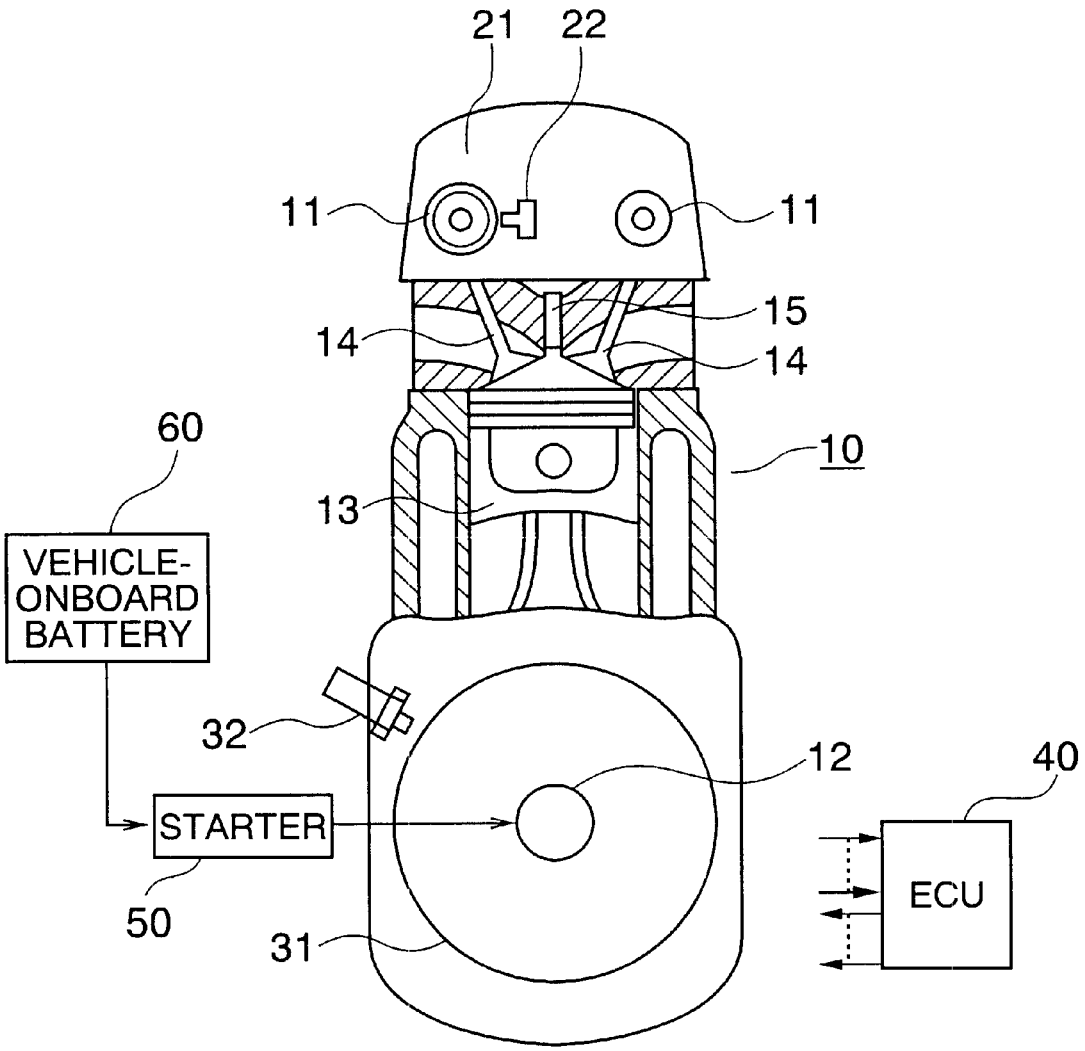
FIG. 1 is a view showing schematically and generally a major portion of an internal combustion engine system according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a view showing schematically and generally a major portion of an internal combustion engine system according to a first embodiment of the present invention.

Referring to FIG. 1, an engine 10 constituting a major part of the internal combustion engine system includes a plurality of pistons 13 disposed movably within a corresponding number of engine cylinders, respectively, for driving rotationally a cam shaft 11 and a crank shaft 12. Each of the cylinders is equipped with a spark plug 15 disposed in a combustion chamber defined within the cylinder and valves 14 for suction of an air-fuel mixture and discharging of an exhaust gas resulting from combustion of the air-fuel mixture within the combustion chamber defined within the cylinder.

The spark plugs 15 and the fuel injection valves (not shown) are controlled by a control unit (electronic control unit or ECU in abbreviation) 40 which is so arranged as to fetch detection information outputted from various types of sensors known in the art (not shown) by way of an input circuit (not shown either) to thereby determine arithmetically control parameters for controlling the operation of the engine 10.

The control unit 40 is comprised of a microcomputer or microprocessor as a major component and includes a CPU (Central Processing Unit), a ROM (Read-Only Memory), a RAM (Random Access Memory), a timer, input/output ports and input/output interfaces and others.

The crank shaft 12 is driven rotationally by the pistons 13 which are displaceable reciprocatively within the associated cylinders, respectively.

On the other hand, the cam shaft 11 is operatively coupled to the crank shaft 12 through the medium of a mechanical transmitting means such as a timing belt (not shown) so that the cam shaft 11 can rotate once completely during the time period in which the crank shaft 12 rotates twice completely. To say in another way, the ratio of rotation of the cam shaft 11 relative to the crank shaft 12 is represented by "1/2".

A signal disk (rotatable disk) 21 which constitutes a part of a cylinder identifying signal generating means is mounted on the cam shaft 11. A cylinder identifying sensor 22 of an electromagnetic pickup type or the like is disposed in opposition to the signal disk 21 for identifying discriminatively the individual cylinders, respectively. The cylinder identifying sensor 22 is designed to generate cylinder identifying pulse signals (hereinafter also referred to as the cylinder identifying pulses), as will be described later on.

Similarly, a signal disk (rotatable disk) 31 which constitutes a part of a crank angle signal generating means is mounted on the crank shaft 12. A crank angle sensor 32 of an electromagnetic pickup type or the like is disposed in opposition to the signal disk 31 for the purpose of detecting crank angle positions. The crank angle sensor 32 is designed to generate crank angle pulse signals (hereinafter also referred to as the crank angle pulses or crank angle pulse train), as will be described hereinafter.

A rotatable shaft or output shaft of a starter 50 is disengageably coupled to the crank shaft 12. The starter 50 is electrically connected to a vehicle-onboard battery (hereinafter also referred to simply as the battery) 60.

The starter 50 is supplied with an electric power from the battery 60 through a power switch and a starter switch (both not shown) which are interlinked with each other. The starter 50 is operatively connected to the crank shaft 12 upon starting of operation of the engine 10, whereby cranking operation of the engine 10 is carried out with electric power being supplied to the starter 50 from the battery 60.

Figure 2:
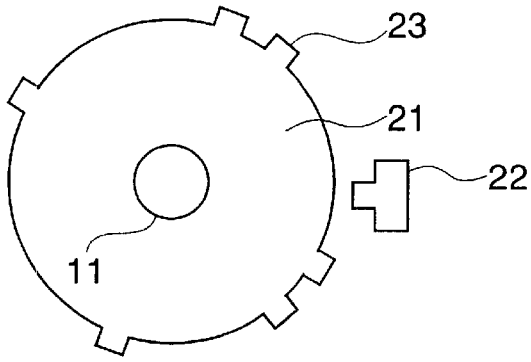
FIG. 2 is a side elevational view showing a peripheral geometry of a signal disk constituting a part of a cylinder identifying signal generating means and mounted on a cam shaft shown in FIG. 1.
Figure 3:
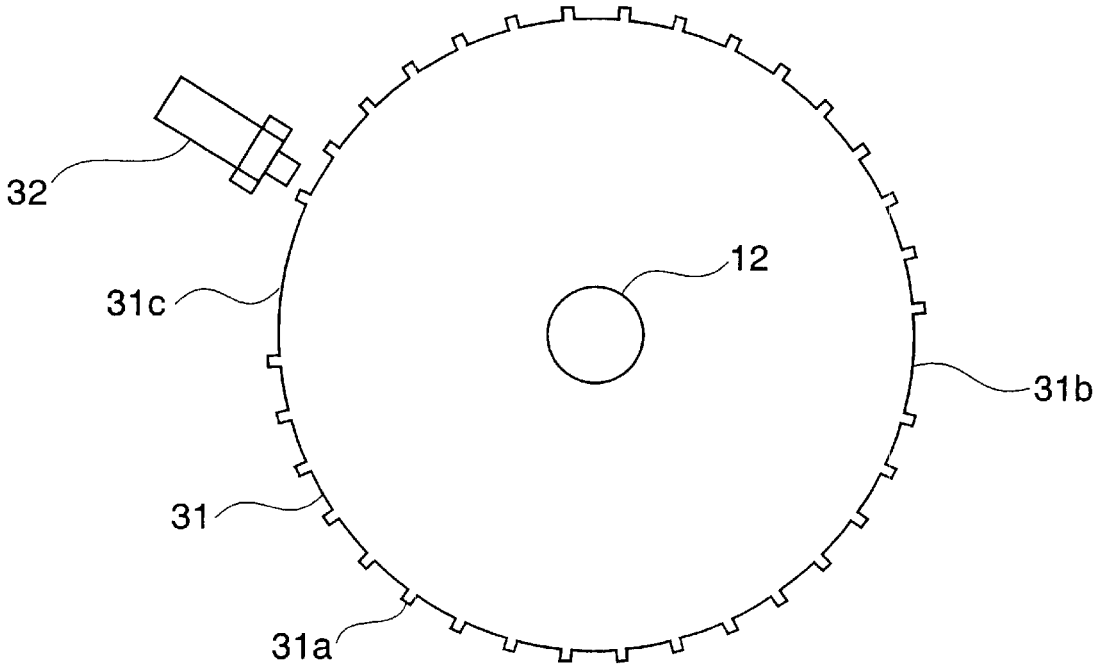
FIG. 3 is a side elevational view showing a peripheral geometry of a signal disk constituting a part of a crank angle signal generating means and mounted on a crank shaft shown in FIG. 1.

FIG. 2 is a side elevational view showing exemplarily a peripheral geometry of the signal disk 21 constituting a part of the cylinder identifying signal generating means, and FIG. 3 is a side elevational view showing exemplarily a peripheral geometry of the signal disk 31 which serves as a part of the crank angle signal generating means, as mentioned previously.

Referring to FIG. 2, the signal disk 21 of the cylinder identifying signal generating means is provided with projections or teeth 23 in an asymmetrical array along the outer peripheral edge of the disk. On the other hand, the signal disk 31 of the crank angle signal generating means is provided with a series of projections 31*a* (also referred to as the teeth) along the peripheral edge with equidistance therebetween.

In this conjunction, it should however be mentioned that the signal disk 31 mounted on the crank shaft is provided with tooth dropout sections 31*b* and 31*c* in each of which neither projections nor teeth are formed along the outer peripheral edge of the signal disk 31. Further, it is to be noted that the angular spans or range of the tooth dropout sections 31*b* and 31*c* differ from each other.

By way of example, the angular range of the tooth dropout section 31*b* is selected to be 20° in terms of the crank angle (hereinafter written as 20° CA), while that of the tooth dropout section 31*c* is selected to be 30° CA.

Referring to FIGS. 1 to 3, when operation or rotation of the engine 10 is started, the signal disk 31 of the crank angle signal generating means mounted on the crank shaft 12 rotates, in the course of which the crank angle sensor 32 detects the projections or teeth 31*a* to thereby generate a crank angle pulse train (also referred to as the crank angle pulses).

Further, the signal disk 21 of the cylinder identifying signal generating means rotates simultaneously with the signal disk 31. In the course of rotation of the signal disk 21, the cylinder identifying sensor 22 detects the projections or teeth 23 to thereby generate the cylinder identifying pulse signals (also referred to as the cylinder identifying pulses).

Figure 4:
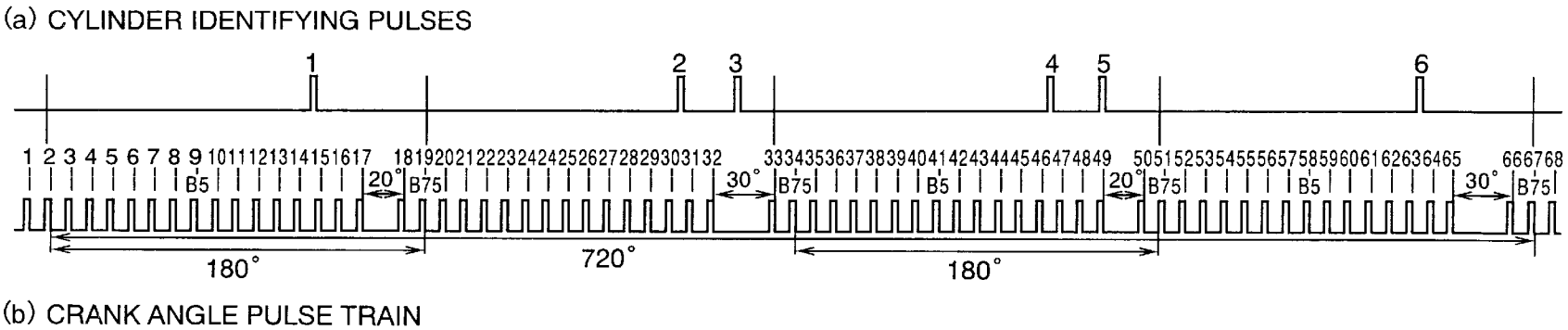
FIG. 4 is a view showing pulse waveform patterns of a crank angle pulse train and cylinder identifying pulse signals generated by the control apparatus according to the first embodiment of the invention.

FIG. 4 is a timing chart showing the cylinder identifying pulses at (a) and a train of crank angle pulses at (b) which are generated by the sensors 22 and 32, respectively, as described previously by reference to FIGS. 1 to 3. In more concrete, FIG. 4 shows, byway of example, pulse signal patterns on the presumption that the internal combustion engine now under consideration is of a four-cylinder type.

FIG. 4 shows the individual sensor output pulses (corresponding to the teeth 31*a*) which are generated during a period (one cycle: 720° CA) in which the four cylinders of the engine 10 are controlled, wherein numerals representative of the pulse numbers are affixed correspondingly to the pulses, respectively.

More specifically, referring to FIG. 4, the cylinder identifying pulse signals detected nonuniformly in correspondence to the individual cylinders are affixed with pulse identifying numbers "Nos. 1, . . . , 6", respectively, while the crank angle pulse signals detected successively with equidistance (or equal interval or pause) therebetween are affixed with the numbers "Nos. 1 to 68", respectively.

In the aforementioned period (720° CA), there are defined as the cylinder identifying intervals two successive reference position intervals (B75° CA to B75° CA, extending over 180° CA) in which the crank angle pulses numbered "Nos. 2 to 19", and "Nos. 19 to 34" as well as "Nos. 34 to 51" and "Nos. 51 to 67" make appearance.

In each of the cylinder identifying intervals (180° CA), the numbers of the cylinder identifying pulses detected from the cam shaft are, respectively, "1 (No. 1)", "2 (Nos. 2 and 3)", "2 (Nos. 4 and 5)" and "1 (No. 6)".

Furthermore, in the crank angle pulse train, pulse dropout portions (also referred to simply as the dropouts only for the convenience of description) "Nos. 17 to 18", "Nos. 32 to 33", "Nos. 49 to 50" and "Nos. 65 to 66" make appearance at every 180° CA (in correspondence to the tooth dropout sections 31*b* and 31*c* shown in FIG. 3) for representing the reference positions (B75° CA) of the individual cylinders, respectively.

The number of the pulse dropout (also referred to as the dropout number) in the individual dropout portions is "one pulse (20° CA)" corresponding to the tooth dropout section 31*b* (see FIG. 3), "two pulses (30° CA)" corresponding to the tooth dropout section 31*c*, "one pulse (20° CA)" corresponding to the tooth dropout section 31*b* and "two pulses (30° CA)" corresponding to the tooth dropout section 31*c*, respectively.

Now, referring to FIG. 4 showing the pulse patterns of the cylinder identifying pulses and the crank angle pulse train together with FIGS. 1 to 3, description will be made of the cylinder identification processing executed by the control apparatus according to the first embodiment of the present invention.

At first, it is assumed that rotation of the engine 10 is started from the time point at which the first crank angle pulse signal "No. 1" is inputted.

The control unit 40 (ECU) detects the crank angle pulse signal outputted from the crank angle sensor 32 at the time point at which the first crank angle pulse signal "No. 1" is inputted while storing the detection time point of the crank angle pulse signal.

Subsequently, at the time point (timing) at which the second crank angle pulse signal "No. 2" is inputted, the control unit 40 stores likewise the detection time point of the crank angle pulse signal to thereby arithmetically determine the time difference (T1) between the time points at which the preceding crank angle pulse and the current crank angle pulse are detected. This time difference is defined as the crank angle pulse signal period.

In succession, through the similar arithmetic processing, the time difference between a preceding detection time point (n−th) and a current ((n+1)−th) detection time point in more general terms is arithmetically determined as the crank angle pulse signal period (Tn) in a sequential manner.

Besides, the control unit 40 is so designed as to make decision as to whether the cylinder identifying pulse signal is detected or not during the period (interval) from the preceding crank angle pulse detection time point to the current crank angle pulse detection time point.

Since no cylinder identifying pulse is detected during the crank angle pulse signal period at the first detection time point, the cylinder identifying pulse number is stored as being "0 (zero) ".

Subsequently, at the detection time point of the fourth crank angle pulse signal "No. 4", the reference position (pulse dropout in the crank angle pulse train) is detected through arithmetic processing in addition to storage of the detection time points of the crank angle pulses "Nos. 1 to 4" and arithmetic determination of the crank angle pulse signal periods (T1 to T3).

More specifically, at the fourth and succeeding crank angle pulse detection time points, arithmetic processing for detecting the reference position (dropout) (arithmetic determination of period ratio K) is carried out by making use of the pre-preceding, preceding and the current crank angle pulse signal periods (T (n−2) T (n−1) and T (n)).

Firstly, when the value of th e period ratio K satisfies the undermentioned expression (1), it is then determined that the current crank angle position does not represent the dropout.

$$K=(T(n-1))2/\{(T(n-2))\times T(n)\}<2.25 \quad (1)$$

On the other hand, when the condition given by the undermentioned expression (2) is satisfied, it is decided that the current crank angle position represents the dropout and that the number of pulse dropout is "one".

$$2.25\leqq(T(n-1))2/\{(T(n-2))\times T(n)\}<6.25 \quad (2)$$

Further, when th condition given by the undermentioned expression (3) is satisfied, it is then decided that the current crank angle position represents the dropout and that the number of pulse (tooth) dropouts is "two".

$$(T(n-1))2/\{(T(n-2))\times T(n)\}\geqq 6.25 \quad (3)$$

In this conjunction, the crank angle pulse signal period except for those of the dropouts is conveniently assumed to be the inter-pulse interval (=10° CA) between the two successive crank angle pulses.

Now, at the detection time point of the fourth crank angle pulse "No. 4", the crank angle pulse signal periods T (n−2), T (n−1) and T(n) assume the following values, respectively.

$$T(n-2)=10[°\mathrm{CA}]$$

$$T(n-1)10[°\mathrm{CA}]$$

$$T(n)=10[°\mathrm{CA}]$$

In this case, the period ratio K assumes the undermentioned value and satisfies the condition given by the expression (1) Namely, $$K=(10\times10)/(10\times10)=1<2.25$$

Thus, at the detection time point of the fourth crank angle pulse "No. 4", it is decided that no pulse dropout is found.

In succession, every time when the crank angle pulse is inputted, storage of the detection time point of the crank angle pulse as well as the arithmetic determination of the crank angle pulse signal period and detection of the reference position are executed sequentially. In this conjunction, it is noted that with the crank angle pulses "Nos. 5 to 18", the condition given by the expression (1) (i.e., K<2.25) is satisfied. Thus, no dropout in the crank pulse train is detected.

However, since the cylinder identifying pulse "No. 1" makes appearance between the crank angle pulse signals "No. 14" and "No. 15", as can be seen in FIG. 4, the number of the cylinder identifying pulse making appearance between the preceding crank angle pulse and the current crank angle pulse is stored as being "1" in the processing of the crank angle pulse "No. 15".

On the other hand, the crank angle pulse signal periods T(n−2), T(n−1) and T(n) stored at the crank angle pulse "No. 19" assume the following values, respectively.

$$T(n-2)=10[°\mathrm{CA}]$$

$$T(n-1)=20[°\mathrm{CA}]$$

$$T(n)=10[°\mathrm{CA}]$$

In this case, the period ratio K assumes the undermentioned value and satisfies the condition given by the expression (2) mentioned previously. Namely, $$K=(20\times20)/(10\times10)=4$$

Thus, at the detection time point of the nineteenth crank angle pulse "No. 19", it is decided that the dropout has occurred and that the number of the dropout pulse (tooth) is "1".

When the dropout determining condition is satisfied as mentioned above, the control unit 40 decides that the crank angle position at that time point represents the reference position "B75° CA".

Further, by paying attention to the period (180° CA) extending from the preceding reference position B75° CA to the current reference position B75° CA, the cylinder identification processing can be executed with high reliability on the basis of combination of the cylinder identifying pulse number "1" and the crank angle pulse dropout number "1".

In succession, determination of t he reference position and the arithmetic processing for discriminatively identifying the cylinder are sequentially executed every time the crank angle pulse is detected.

Figure 5:
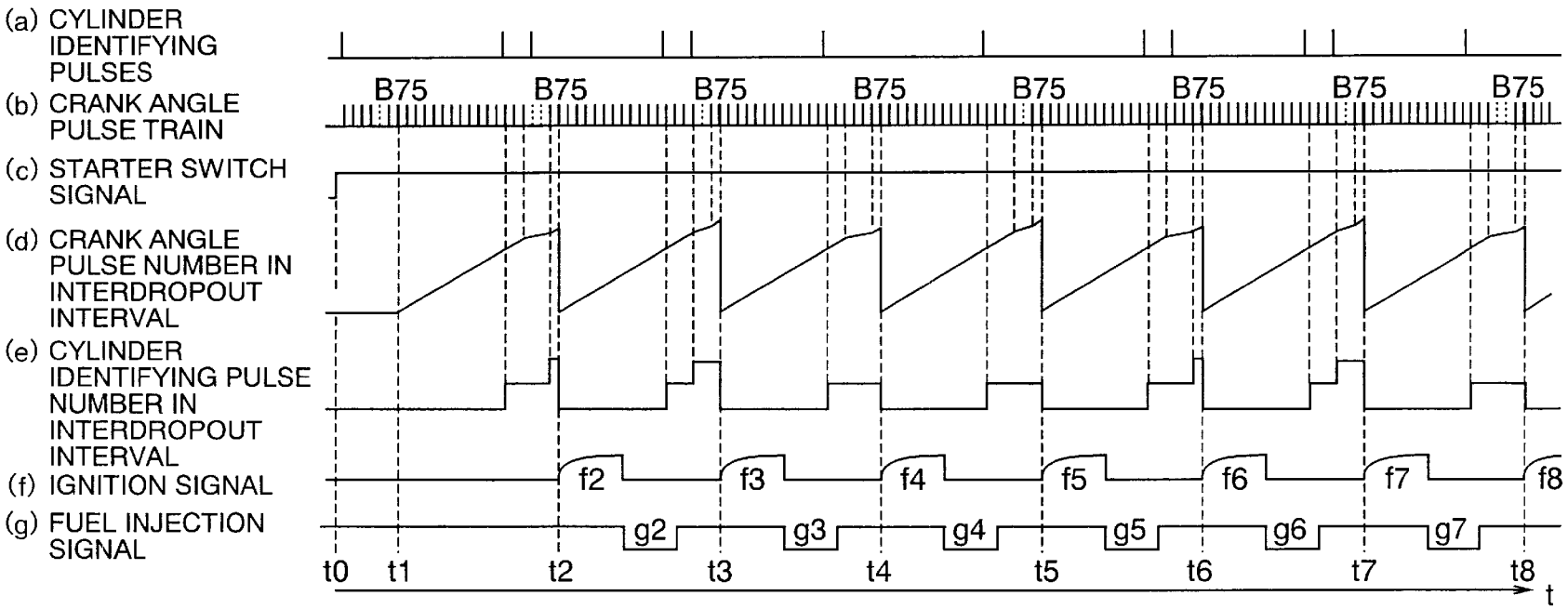
FIG. 5 is a timing chart for illustrating processing operations involved in an ignition control and a fuel injection control performed in an ordinary engine starting phase by the control apparatus according to the first embodiment of the invention.

Next, referring to FIG. 5 showing a timing chart, description will be made of the cylinder identification processing, fuel injection control and the ignition control performed by the control apparatus according to the first embodiment of the invention in the engine starting operation.

In FIG. 5, there are shown in addition to the cylinder identifying pulse signals (a) and the crank angle pulse train (b) described hereinbefore (see FIG. 4), a starter switch signal (c), the crank angle pulse numbers (d) in the inter-dropout interval (i.e., interval between two successive pulse dropouts), respectively, the cylinder identifying pulse numbers (e) in the inter-dropout intervals, respectively, the ignition signal (f) and the fuel injection signal (g) as a function of time t taken along the abscissa.

The crank angle pulse number (d) corresponds to the count value of a counter designed for counting the pulse number of the crank angle pulses in the interval between the two successive dropouts (two successive reference positions of B75° CA) Similarly, the cylinder identifying pulse number (e) corresponds to the count value of a counter designed for counting the number of the cylinder identifying pulses in the interval between the two successive dropouts (two successive reference positions of B75° CA)

In actuality, the ignition signal (f) is controlled individually or separately for each of the cylinders of the four-cylinder engine. However, for the convenience of description, the ignition signals for all the cylinders are shown en bloc as a signal series containing the ignition signals f2, f3, . . . , f8 in this sequence.

Likewise, the fuel injection signals (g) are shown as a signal series containing the fuel injection signals g2, . . . , g7 in this order.

Now, it is assumed that the starter switch is turned on (closed) at the time point t0 shown in FIG. 5. Then, rotation of the engine 10 is started and at the same time operation of detecting the crank angle pulse and the cylinder identifying pulse is started.

At the time point t1, a dropout (reference position B75) is detected. However, since this is the dropout detected at the first time, the cylinder identification processing is not executed.

Subsequently, every time the crank angle pulse signal is inputted, decision as to the reference position is performed while the number of the crank angle pulses (also referred to as the crank angle pulse number) in each inter-dropout interval is counted incrementally.

Additionally, every time the cylinder identifying pulse is inputted, the cylinder identifying pulse number in each inter-dropout interval are counted, whereon the number of the cylinder identifying pulse number in the inter-dropout interval is updated at the time point when the succeeding crank angle pulse signal is detected.

Next, at the time point t2 at which the second dropout (reference position B75) is detected, the processing for determining the reference position is executed.

Additionally, only when the number of the crank angle pulses in the interval between the preceding dropout and the current dropout (i.e., interval from B75 to B75) indicates the predetermined value ("16" or "17"), the cylinder identification processing is executed on the basis of combination of the dropout pulse number ("1"or"2") determined through the reference position decision processing and the cylinder identifying pulse number ("1" or "2") in the interval.

When the cylinder identification is validated at the time point t2, the cylinder identifying pulse number and the crank angle pulse number in the inter-dropout interval are reset, whereupon the ignition signal f2 and the fuel injection signal g2 for the control-subjected cylinder are outputted on the basis of the identified cylinder information.

In succession, determination of the dropout number ("1" or "2") and counting of the cylinder identifying pulses ("1" or "2") in the reference position interval are similarly performed every time the reference position B75 is detected at the time points t3, . . . , t8, respectively.

Furthermore, the cylinder identification processing is executed on the basis of combinations of the pulse numbers as determined and counted, whereby the ignition signals f3, f4, . . . and the fuel injection signals g3, g4, . . . are outputted.

By performing successively the processing described above, operation of the engine 10 is actually started to reach the ordinary operation state.

Figure 6:
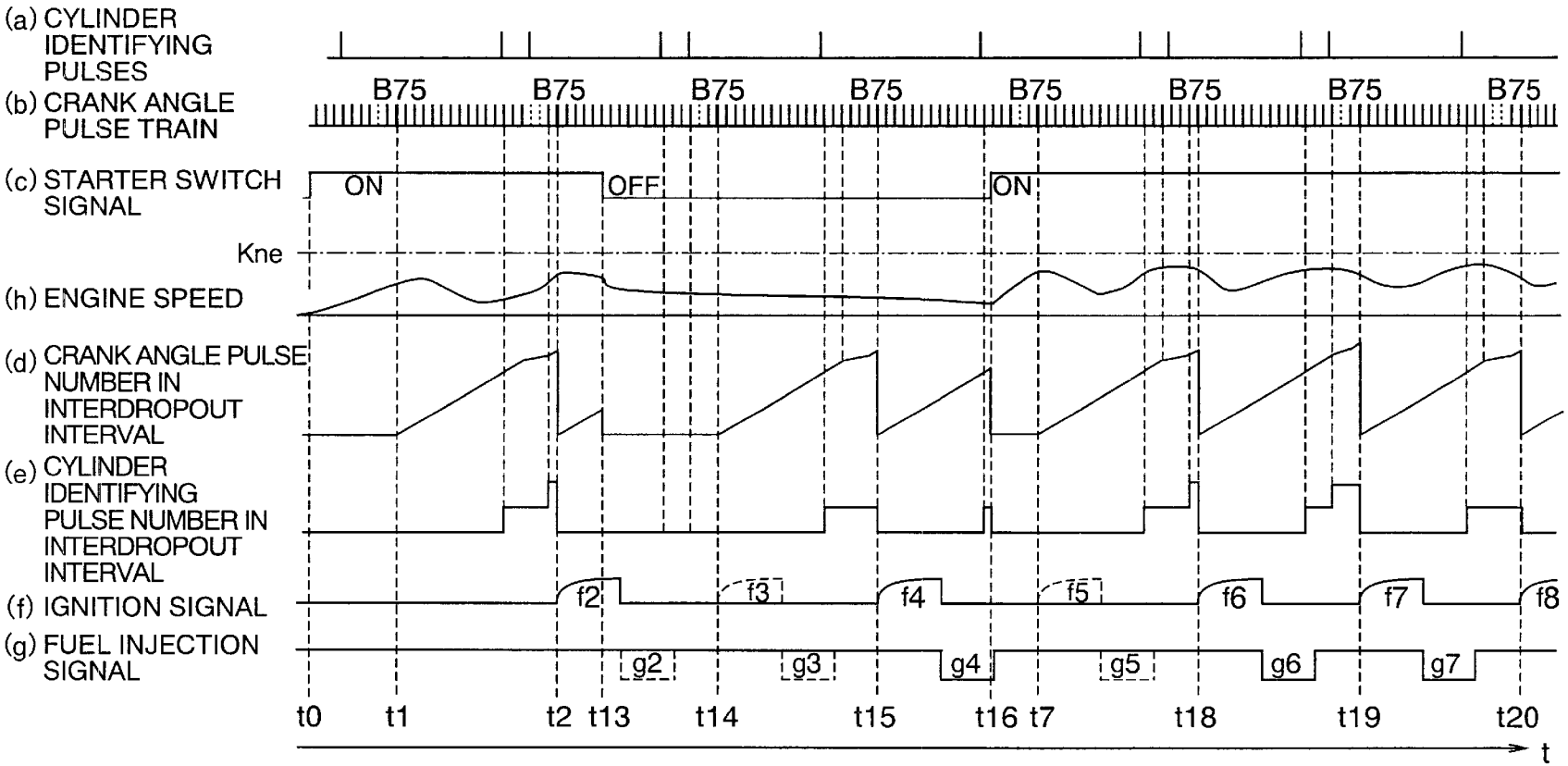
FIG. 6 is a timing chart for illustrating processing operations involved in an ignition control and a fuel injection control performed in response to starter switch changeover operation by the control apparatus according to the first embodiment of the invention.

Next, referring to a timing chart shown in FIG. 6, description will be directed to the control operation when the starter switch is repetitively turned on and off during the cranking operation before the engine starting operation has been completed.

In the timing chart of FIG. 6, there is illustrated change (h) of the engine rotation speed NE (instantaneous value) as a function of time in addition to the signals (a) to (g) described previously in conjunction with FIG. 5.

Since the engine rotation speed (rpm) NE becomes lower in the vicinity of the top dead center (TDC) in the compression stroke even during the period in which the starter switch is closed, the engine rotation speed NE changes periodically, as can be seen in FIG. 6.

In particular, in case the starter switch is turned off before the engine operation has been started, the engine rotation speed (rpm) NE further decreases and becomes unstable. As a result of this, the rotation of the engine is likely to be reversed in the vicinity of the top dead center (TDC). However, in the timing chart shown in FIG. 6, it is presumed that the engine rotation speed (rpm) NE does not reach yet the level at which reversion of rotation can occur.

In the first place, when the starter switch is closed (ON) at the time point t0, operation of the engine 10 is started with the crank angle pulse and the cylinder identifying pulse being detected. At the time point t1 at which the first dropout (reference position) is detected, the cylinder identification processing is not executed.

Subsequently, in the inter-dropout interval (B75—B75), determination of the reference position and the incremental counting of the pulses in the inter-dropout interval are carried out every time the crank angle pulse signal is inputted, while the pulse number of the cylinder identifying pulse signal in the inter-dropout interval is incrementally counted every time the cylinder identifying pulse signal is inputted. The counter for counting the pulse number of the cylinder identifying pulse signal in the inter-dropout interval is updated at the time point when the succeeding crank angle pulse is detected.

In succession, at the detection time point t2, the succeeding dropout (reference position B75) is determined. When the number of the crank angle pulses in the interval between the preceding dropout and the current dropout represents a predetermined value, cylinder identification is carried out on the basis of a combination of the pulse dropout number determined at the reference position and the cylinder identifying pulse number in the inter-dropout interval.

When the cylinder identification is validated, the cylinder identifying pulse number and the crank angle pulse number in the inter-dropout interval are reset and at the same time the ignition signal f2 is outputted to the control-subjected cylinder on the basis of the cylinder identification information.

Subsequently, when the starter switch is opened (turned off) at the time point t13 in the state where the engine rotation speed (rpm) NE is lower than a predetermined speed Kne (rotation speed when the engine starting operation is actually started), then the crank angle pulse signal period Tn may increase transiently or the engine rotation may be reversed, giving rise to the possibility that the cylinder identification is not performed normally or properly.

Under the circumstances, the cylinder identification information (i.e., cylinder identifying pulse number and crank angle pulse number in the inter-dropout interval) is cleared to zero, while the output of the fuel injection signal g2 is invalidated at the time point t13, as shown in phantom in FIG. 6.

Subsequently, counting of the cylinder identifying pulses and the crank angle pulses in the inter-dropout interval are also inhibited up to the time point t14 at which the succeeding dropout is detected.

When the dropout is detected at the time point t14, counting of the cylinder identifying pulses and the crank angle pulses in the inter-dropout interval is resumed. It is however to be noted that at the time point t14, neither the ignition signal f3 nor the fuel injection signal g3 is outputted, as shown in phantom.

Next, when the crank angle pulse number in the inter-dropout interval assumes a predetermined value at the time point t15 the succeeding dropout (reference position B75), the cylinder identification is carried out on the basis of a combination of the dropout number as determined and the number of the cylinder identifying pulses in the inter-dropout interval, whereupon the ignition signal f4 and the fuel injection signal g4 are outputted for the control-subjected cylinder on the basis of the cylinder identification information.

Further, when the starter switch is changed over to the on-state from the off-state at the time point t16 in the state in which the engine rotation speed (rpm) NE is lower than the predetermined speed Kne, then the cylinder identification information (the number of the cylinder identifying pulses and the number of the crank angle pulses in the inter-dropout interval) are reset.

In this case, neither the crank angle pulses in the inter-dropout interval nor the cylinder identifying pulses are counted till the time point t17 at which the succeeding dropout (reference position B75) is detected with the output of the ignition signal and the fuel injection signal being inhibited.

Subsequently, when the dropout (reference position B75) is detected at the time point t17, then the number of the cylinder identifying pulses and the number of the crank angle pulses in the inter-dropout interval are counted. However, at the time point t17, neither the ignition signal f5 nor the fuel injection signal g5 are outputted, as shown in phantom.

Thereafter, at the time point t18, the detection of the dropout is performed. In that case, when the number of the crank angle pulses in the inter-dropout interval assumes the predetermined value, the cylinder identification is carried out on the basis of a combination of the number of the dropouts at that time point and the number of the cylinder identifying pulses in the inter-dropout interval.

The ignition signal f6 and the fuel injection signal g6 are outputted for the control-subjected cylinder on the basis of the cylinder identification information.

In succession, at the time points t19 and t20, detection of the dropout is carried out. When the number of the crank angle pulses in the inter-dropout interval assumes the predetermined value, cylinder identification processing is executed on the basis of combination of the dropout number and the number of the cylinder identifying pulses in the inter-dropout interval, to thereby allow the ignition signals f7 and f8 as well as the fuel injection signals g7 and g8 to be outputted for the control-subjected cylinder as identified.

As can now be understood from the foregoing, when the cranking switch is turned on/off in the state where the engine rotation speed NE is low in the cranking mode, indicating that the engine operation has not been completed yet, then the cylinder identification information is once reset, whereon the cylinder identification processing is again started after confirming that the engine rotation is normal.

In this way, erroneous cylinder identification ascribable to erroneous detection of the reference position, deviation of the detected angle and erroneous detection of the cylinder identifying pulse number which may otherwise be brought about by repetition of on/off-manipulation of the starter switch can positively be prevented.

Additionally, because detected angle deviation and erroneous cylinder identification can be prevented, it is possible to inhibit the fuel injection signal and the ignition signal from being outputted to the improper cylinder at deviated angular position. Thus, occurrence of the undesirable events such as backfire, engine lock or the like can be evaded.

Figure 7:
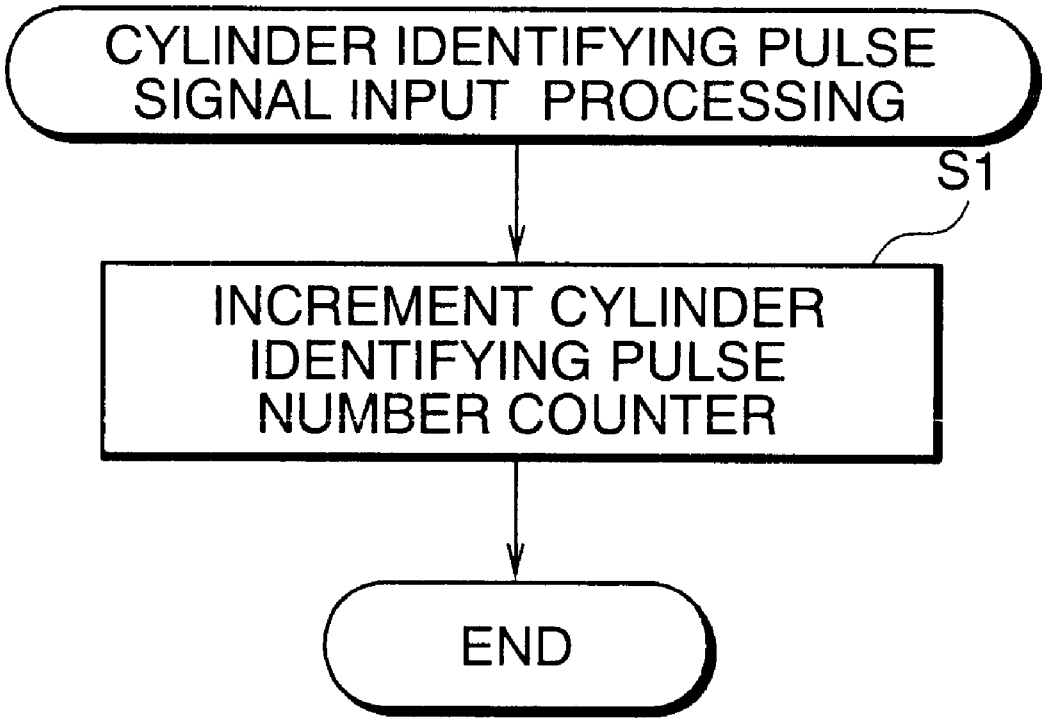
FIG. 7 is a flow chart for illustrating a processing routine which is executed every time a cylinder identifying pulse signal is inputted according to the first embodiment of the invention.

Next, referring to flow charts shown in FIGS. 7 and 8, description will be made in detail of the processings executed by the control apparatus according to the first embodiment of the invention. FIG. 7 shows a processing routine which is executed every time the cylinder identifying pulse signal is inputted, and FIG. 8 shows a processing routine executed every time the crank angle pulse signal is inputted.

Referring to FIG. 7, upon detection of the cylinder identifying pulse signal inputted, the count value of the cylinder identifying pulse number is incremented (step S1), whereupon the processing routine shown in FIG. 7 comes to an end.

Figure 8:
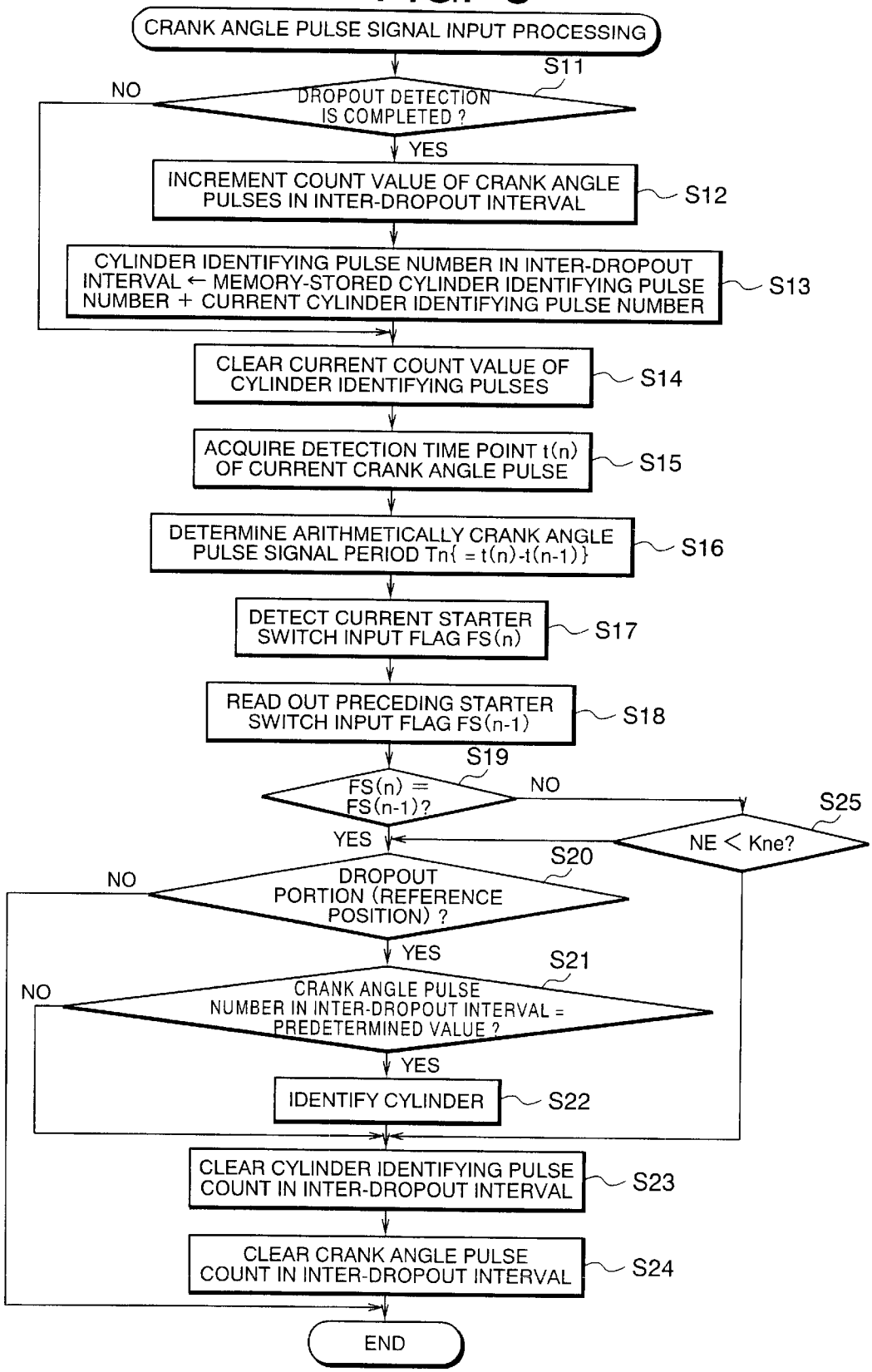
FIG. 8 is a flow chart for illustrating a processing routine executed every time a crank angle pulse signal is inputted according to the first embodiment of the invention.

Referring to FIG. 8, it is first decided whether or not detection of the dropout has already been completed (or executed) in a step S11. When the dropout detection has been completed (i.e., when the decision step S11 results in affirmation "YES")), the count value of the crank angle pulses in the inter-dropout interval is incremented (step S12).

Further, the cylinder identifying pulse number in the dropout interval as stored in the memory up to the preceding crank angle pulse input processing inclusive thereof is added to the number of the current cylinder identifying pulses detected during the period from the preceding to the current crank angle pulse input processing, to thereby update the cylinder identifying pulse number in the inter-dropout interval (step S13).

When the update processing of the cylinder identifying pulse number in the inter-dropout interval (step S13) has been completed in this manner, the count value of the current cylinder identifying pulse number stored in the memory is cleared (step S14).

Incidentally, when it is decided in the step S11 that the first dropout detection has not been completed yet (i.e., when the decision step S11 results in negation "NO"), the processing immediately proceeds to the step S14 without executing the steps S12 and S13. Furthermore, once the dropout detection has been completed, the processing always proceeds to the step S12 from the step S11.

Subsequently, the detection time point of the current crank angle pulse is acquired (step S15) to arithmetically determine the time difference between the detection time point of the preceding crank angle pulse and that of the current crank angle pulse as the crank angle pulse signal period (step f16).

In succession, the current starter switch input flag FS (n) is referenced (step S17) while reading out the preceding starter switch input flag FS(n−1) in a step S18 to thereby compare the preceding input flag FS(n−1) with the current input flag FS (n) for making decision as to coincidence therebetween (step S19)

In this conjunction, it is to be mentioned that the starter switch input flag FS is set to "1" when the starter is in the on-state while being set to "1" when the starter is in the off-state.

Accordingly, unless the starter switch is changed over to the off-state from the on-state during the period from the preceding crank angle pulse input processing to the current crank angle pulse input processing, both the preceding input flag FS(n−1) and the current input flag FS(n) are "1", indicating coincidence between them.

In case the input flag FS of the starter switch has undergone no change and thus it is decided in the step S19 that FS(n)t=FS(n−1) (i.e., when the step S19 results in "YES"), then arithmetic processing for determining the reference position (B75CA) is executed on the basis of the crank angle pulse signal period ratio {=(T(n))/(T(n−1))} in a step S20.

More specifically, it is decided whether or not the current crank angle position represents the dropout (reference position B75) by deciding whether or not the crank angle pulse signal period ratio is equal to or greater than a predetermined value (e.g. "2") in the step S20.

When the dropout is determined in the step S20, decision is then made as to whether the number of the crank angle pulses in the inter-dropout interval is equal to the predetermined value ("16" or "17") in a step S21.

When it is decided in the step S21 that the crank angle pulse number is equal to the predetermined value (i.e., when the step S21 results in "YES"), then the cylinder identification processing is executed (step S22). After the cylinder identification processing has been completed, the count value of the cylinder identifying pulses in the inter-dropout interval is cleared to zero (step S23). Additionally, the count value of the crank angle pulses in the inter-dropout interval is also cleared to zero (step S24). In this way, the count values are restored to the initial values, whereupon the processing routine shown in FIG. 8 comes to an end.

On the other hand, when it is decided in the step S20 that the current crank angle pulse signal period ratio is smaller than the predetermined value (i.e., when the step S20 results in "NO"), indicating no reference position, then the processing routine illustrated in FIG. 8 is immediately terminated.

Further, when it is decided in the step S21 that the number of the crank angle pulses in the inter-dropout interval is not the predetermined value (i.e., when the step S21 is "NO"), the processing then proceeds to the steps S23 and S24 without executing the cylinder identification processing step S22.

Furthermore, when it is decided in the step S19 that FS(n) ≠FS(n−1) (i.e., when the step S19 results in "NO"), this means that the state of the starter switch has been changed over. Accordingly, decision is made succeedingly as to whether or not the engine rotation speed (rpm) NE is lower than the predetermined speed Kne (step S25).

When it is determined in the step S25 that NE≧Kne (i.e., when the step S25 results in "NO"), then the processing proceeds to the step S20 where the arithmetic processing for determining the reference position is executed.

On the other hand, in case it is decided in the step S25 that NE<Kne (i.e., when the step S25 results in "YES"), then the processing proceeds to the step S23 by skipping the steps S20 to S22. In the step S23, the cylinder identification information stored until then is cleared, whereupon the processing routine shown in FIG. 8 is terminated.

In this manner, changeover operation of the off/on state of the starter (stoppage of the cranking operation and restart thereof) is detected in the step S19. When the starter driving state has changed and when the engine rotation speed NE is lower than the predetermined speed Kne, the cylinder identification information detected till then is cleared to thereby inhibit the cylinder identification information from being used in the succeeding cylinder identification processing.

Further, in case the reference position is not detected in the step S20, the crank angle pulse input processing is immediately terminated. Besides, unless the number of the crank angle pulses in the inter-dropout interval coincides with the predetermined value, the cylinder identification step S22 is skipped to terminate the crank angle pulse input processing while clearing the cylinder identification information.

In this manner, it is possible to prevent erroneous control of the ignition, the fuel injection and others by suppressing erroneous detection of the reference position as well as erroneous cylinder identification. Furthermore, once the driving state of the starter has been detected, the cylinder identification processing is not executed until it is detected that the engine rotation speed NE has reached the normal or steady rotation state.

Embodiment 2

In the control apparatus for the internal combustion engine according to the first embodiment of the invention described above, repetition of the on- and off-states of the starter is decided on the basis of the input flags FS(n) and FS(n−1) of the starter switch. A second embodiment of the present invention is directed to the arrangement in which repetition of the on- and off-states of the starter is determined on the basis of change in the output voltage VB of the battery 60 (see FIG. 1). Hereinafter, the output voltage VB will also be referred to as the battery voltage.

Now, referring to a flow chart shown in FIG. 9, description will be made of the processing procedure executed by the control apparatus according to the instant embodiment of the invention which is so arranged as to detect the changeover of the starter operation on the basis of change in the battery voltage VB.

Figure 9:
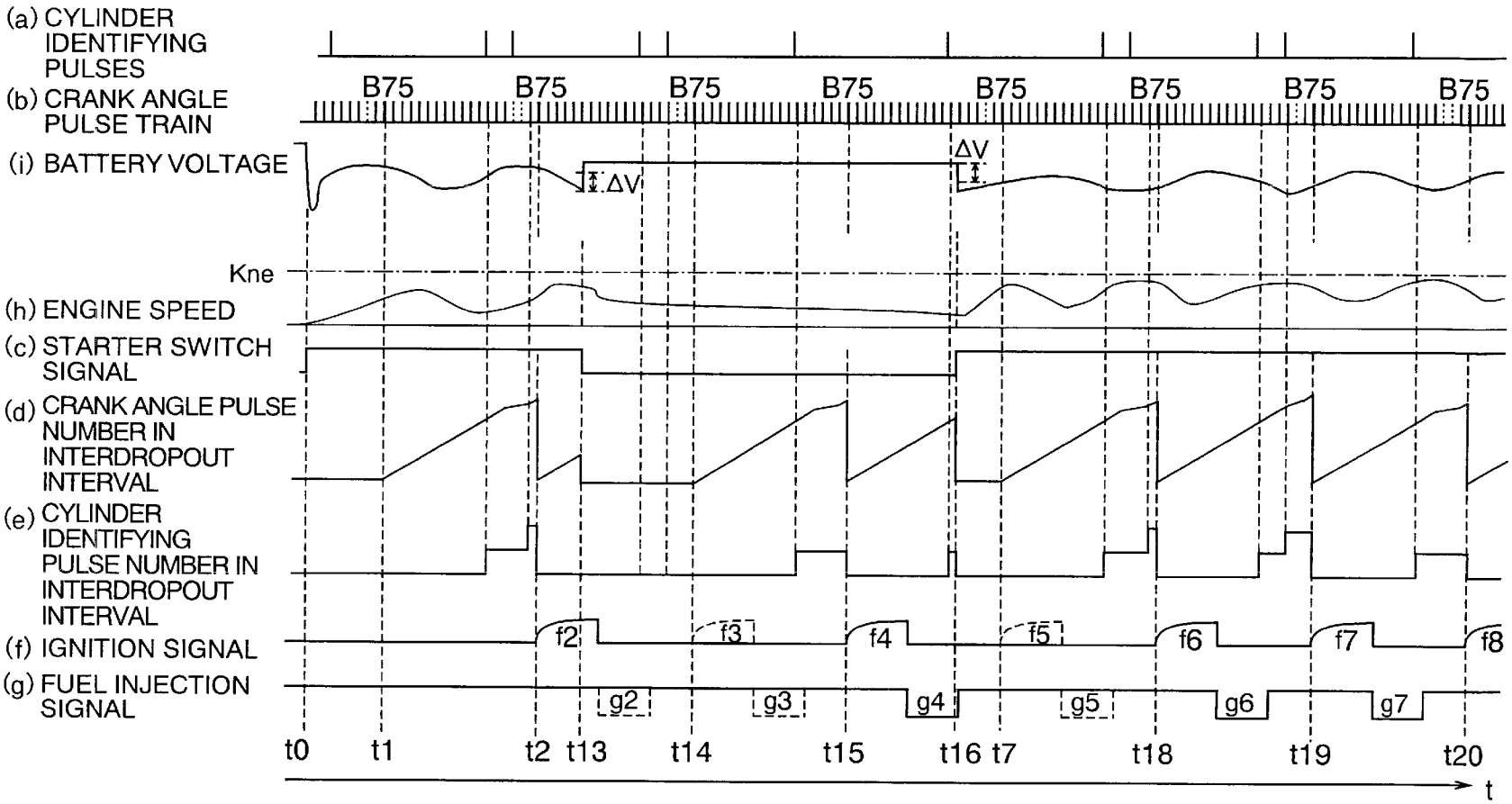
FIG. 9 is a timing chart for illustrating a processing operations involved in the ignition control and the fuel injection control in response to starter switch changeover operation performed by the control apparatus according to a second embodiment of the present invention.

In FIG. 9, change (i) of the battery voltage VB (instantaneous value) as a function of time is shown in addition to the signals (a) to (h) described previously (see FIG. 6).

Operation of the control apparatus according to the instant embodiment of the invention differs essentially from the first embodiment in respect that the on-/off-states of the starter switch are determined or decided on the basis of the mode in which the battery voltage VB changes. Except for this feature, the second embodiment of the invention is substantially same as the first embodiment (see FIG. 6).

Incidentally, in FIG. 9, the starter switch signal (c) is shown only for the convenience of illustration. In this conjunction, it is presumed that the starter switch signal (c) is not inputted to the control unit 40 (FIG. 1) constituted by an electronic control unit (ECU).

In the case where the starter switch signal (c) is not inputted to the control unit 40, it is impossible to detect straightforwardly whether the starter is driven or not on the basis of change of the starter switch signal (c). Consequently, the cylinder identification information can not be reset upon on/off changeover of the starter switch without resorting to any other measures.

Thus, according to the teaching of the present invention incarnated in the second embodiment thereof, the on-/off-states of the starter switch are detected on the basis of change in the battery voltage VB during the cranking operation with a view to preventing erroneous control of the fuel injection and the ignition ascribable to the on-/off-changeover of the starter switch.

Referring to FIG. 9, when the starter switch is turned on (closed) at the time point t0, rotation of the engine 10 is started and at the same time detection of the crank angle pulse and the cylinder identifying pulse is started.

Since the starter switch signal is not inputted to the control unit 40 at this time point, the control unit 40 is incapable of discriminatively determining whether the starter switch is in the on-state.

Subsequently, at the time point t1, the dropout of the crank angle pulse train is detected and the processing for determining the reference position is carried out. However, since the time point t1 represents the first timing for determination of the dropout portion, the cylinder identification processing is not executed.

Subsequently, determination of the reference position as well as incremental counting of the crank angle pulses in the inter-dropout interval is carried out every time the crank angle pulse is inputted. In addition, incremental counting of the cylinder identifying pulses is performed upon every inputting of the cylinder identifying pulse, whereon the cylinder identifying pulse number in the inter-dropout interval is updated at the time point when the succeeding crank angle pulse is detected.

In succession, decision as to the reference position is made at the second dropout detection time point t2. In that case, when the number of the crank angle pulses in the inter-dropout interval represents the predetermined value, then the cylinder identification is carried out on the basis of combination of the number of the pulse dropouts and the number of the cylinder identifying pulses in the dropout interval as determined through the reference position decision processing.

When the cylinder identification is effected in this manner, the number of the crank angle pulses and that of the cylinder identifying pulses in the inter-dropout interval are reset while the ignition signal (f2) is outputted to the relevant control-subjected cylinder on the basis of the result of the cylinder identification.

Thereafter, when the starter switch is changed over from the on-state to the off-state through manipulation by the operator or driver, the current consumption of the battery 60 decreases rapidly with the battery voltage VB increasing steeply.

In that case, the change rate (absolute value) of the battery voltage VB within the arithmetic operation processing (1 to several milliseconds) exceeds a predetermined value ΔV (e.g. ⅕ to ½ of the rated voltage of e.g. 14 volts), the control unit 40 can determine that the starter switch has been changed over to the off-state (non-driving state of the starter).

On the other hand, at the time point t13, the engine rotation speed NE is lower than the predetermined speed Kne, indicating the possibility that the current crank angle pulse signal period Tn may increase temporarily and/or rotation of the engine 10 may be reversed, which renders it impossible to perform the cylinder identification properly. Accordingly, the cylinder identification information (the number of the cylinder identifying pulses and the number of the crank angle pulses in the inter-dropout interval) is cleared.

Further, at the time point t13, output of the fuel injection signal g2 is also inhibited.

Thereafter, counting of the cylinder identifying pulses and the crank angle pulses in the dropout interval is not carried out up to the succeeding dropout detection time point t14. Only when the pulse dropout (reference position B75) is detected at the time point t14, counting of the cylinder identifying pulses and the crank angle pulses in the dropout interval is restarted.

In succession, the dropout detection processing is executed at the time point t15. More specifically, when the crank angle pulse number in the dropout interval indicates the predetermined value, the cylinder identification is carried out on the basis of combination of the number of the dropouts and the number of the cylinder identifying pulses in the dropout interval as determined, to thereby allow the ignition signal f4 and the fuel injection signal g4 to be outputted to the control-subjected cylinder on the basis of the acquired cylinder identification information.

Further, when the starter switch is again changed over from the off-state to the on-state at the time point t16 in the state in which the engine rotation speed (rpm) NE is lower than the predetermined speed Kne, the battery voltage VB lowers steeply with the current consumption of the battery increasing rapidly.

In this case, since the change rate of the battery voltage VB increases beyond the predetermined value ΔV, it can be determined that the starter switch has been changed over to the on-state. In that case, the cylinder identification condition is reset, as described hereinbefore.

Thereafter, counting of the cylinder identifying pulses and the crank angle pulses in the dropout interval is not carried out up to the succeeding dropout detection time point t17 with the output of the ignition signal and the fuel injection signal being stopped.

Subsequently, after having executed the dropout detection processing at the time point t17, counting of the crank angle pulses and the cylinder identifying pulses in the inter-dropout interval is restarted.

Further, the cylinder identification is carried out at the succeeding dropout detection time point t8 to thereby allow the ignition signal f6 and the fuel injection signal g6 to be outputted to the control-subjected cylinder as identified.

Similarly, the cylinder identification is performed at the dropout detection time points t19 and t20 as well with the ignition signal and the fuel injection signal being outputted to the control-subjected cylinder.

As is apparent from the foregoing, it is possible according to the teaching of the invention incarnated in the second embodiment to determine the on- and off-states of the starter switch on the basis of changes in the battery voltage even in the case where the starter switch signal is not inputted to the control unit 40.

Thus, when the starter switch is turned on/off in the state in which the engine rotation speed (rpm) NE is low (operation of the engine 10 has not been started yet) during the cranking operation, it is possible to prevent erroneous detection of the crank angle position and erroneous identification of the cylinder.

Thus, the fuel injection signal and the ignition signal can positively be prevented from being outputted to the cylinder which is not subjected to the control, whereby occurrence of backfire, engine lock or the like unwanted events can be avoided. Effects of the Invention As is apparent from the foregoing, the present invention has provided the control apparatus for the internal combustion engine. The control apparatus includes the starter driven for rotation upon starting operation of an internal combustion engine, the crank shaft directly coupled to the internal combustion engine for corotation therewith, the crank shaft disk rotatable in synchronism with the crank shaft, angular position detecting members provided with equidistance therebetween along an outer peripheral edge of the crank shaft disk so as to correspond to a plurality of crank angle positions of the internal combustion engine, the dropout sections for forming unequidistance portions partially in the angular position detecting members so as to correspond to the reference crank angle positions, respectively, of cylinders of the internal combustion engine, the crank angle sensor disposed in opposition to the angular position detecting members for generating crank angle pulse signals representing the crank angle positions, the cam shaft rotatable at the rotation ratio of 1/2 relative to the crank shaft, the cam shaft disk rotatable in synchronism with the cam shaft, cylinder identification information detecting members provided along an outer periphery of the cam shaft disk so as to make available cylinder identification information of the internal combustion engine, the cylinder identifying sensor disposed in opposition to the cylinder identification information detecting members for generating cylinder identifying pulse signals representing the cylinder identification information, and an electronic control u nit f or controlling each of the cylinders of the internal combustion engine on the basis of the crank angle pulse signals and the cylinder identifying pulse signals.

The electronic control unit includes the cylinder identifying means for discriminatively identifying each of the cylinders of the internal combustion engine by making use of the crank angle position based on the crank angle pulse signals and the cylinder identification information based on the cylinder identifying pulse signals, the crank angle signal period arithmetic means for arithmetically determining input periods of the crank angle pulse signals as crank angle pulse signal periods, the starter drive detecting means for detecting changeover of driving state of the starter, the rotation speed detecting means for detecting rotation speed of the internal combustion engine, and the cylinder identification information invalidating means responsive to changeover of the starter driving state between driving state and non-driving state in an operation state in which the crank angle pulse signal period is longer than the predetermined period and in which rotation speed of the internal combustion engine is lower than the predetermined speed, for thereby invalidating the cylinder identification information detected before changeover of the starter driving state to inhibit the cylinder identification information from being employed in the succeeding cylinder identification.

By virtue of the arrangement of the engine control apparatus described above, there can be realized the control apparatus which is capable of suppressing positively the erroneous detection of the crank angle position and the cylinders while avoiding the erroneous control of the ignition and the fuel injection by inhibiting the cylinder identification information already detected from being employed in a succeeding cylinder identification when the on/off operation of the starter switch is detected in the course of starting the operation of the engine.

In the control apparatus described above, the cylinder identification information invalidating means can be so designed that when the driving state of the starter is changed over, the crank angle pulse signals and the cylinder identifying pulse signals are inhibited from being employed for the cylinder identification over the predetermined time period.

With the arrangement described above, there can be realized the engine control apparatus which can prevent the erroneous detection of the crank angle position and the cylinders to thereby exclude the erroneous control of the ignition and the fuel injection.

Further, in the control apparatus described above, the cylinder identifying means can be so designed as to perform cylinder identification at the time point at which the number of the crank angle pulse signals detected during the period intervening between two successive reference crank angle positions becomes coincident with the predetermined value after changeover of the driving state of the starter.

With the arrangement described above, there can be realized the engine control apparatus which is insusceptible to the erroneous detection of the crank angle position and the cylinders and thus can evade the erroneous control of the ignition and the fuel injection, whereby enhanced reliability can be ensured for the cylinder identification and the cylinder control.

Furthermore, in the control apparatus described above, the electronic control unit can be so designed as to stop at least one of the fuel injection control and an ignition control for each of the cylinders of the internal combustion engine until the condition for the succeeding cylinder identification is satisfied after changeover of the driving state of the starter.

With the arrangement described above, there can be realized the engine control apparatus which can avoid the erroneous detection of the crank angle position and the cylinders and at the same time prevent the erroneous control of the ignition and the fuel injection, while ensuring enhanced reliability for the cylinder identification and the cylinder control.

Additionally, in the control apparatus described above, the starter drive detecting means can be so designed as to respond to the cranking switch signal for electrically energizing the starter.

With the arrangement described above, there can be realized the engine control apparatus which is insusceptible to the erroneous detection of the crank angle position and the cylinders, whereby the erroneous control of the ignition and the fuel injection can positively be suppressed with enhanced reliability.

Moreover, in the control apparatus described above, the starter drive detecting means can be so designed as to respond to change of voltage of the battery.

With the arrangement described above, there can be realized the engine control apparatus which can evade not only the erroneous detection of the crank angle position and the cylinders but also the erroneous control of the ignition and the fuel injection even when the cranking switch signal is unavailable.

Many modifications and variations of the present invention are possible in the light of the above techniques. It is therefore to be understood that within the scope of the appended claims, the invention may be practiced otherwise than as specifically described.

What is claimed is:

1. A control apparatus for an internal combustion engine, comprising:

a starter driven for rotation upon starting operation of an internal combustion engine;

a crank shaft directly coupled to said internal combustion engine for corotation therewith;

a crank shaft disk rotatable in synchronism with said crank shaft;

angular position detecting members provided with equidistance therebetween along an outer peripheral edge of said crank shaft disk so as to correspond to a plurality of crank angle positions of said internal combustion engine;

dropout sections for forming unequidistance portions partially in said angular position detecting members so as to correspond to reference crank angle positions, respectively, of cylinders of said internal combustion engine;

a crank angle sensor disposed in opposition to said angular position detecting members for generating crank angle pulse signals representing said crank angle positions;

a cam shaft rotatable at a rotation ratio of 1/2 relative to said crank shaft;

a cam shaft disk rotatable in synchronism with said cam shaft;

cylinder identification information detecting members provided along an outer periphery of said cam shaft disk so as to make available cylinder identification information of said internal combustion engine;

a cylinder identifying sensor disposed in opposition to said cylinder identification information detecting members for generating cylinder identifying pulse signals representing said cylinder identification information; and an electronic control unit for controlling each of said cylinders of said internal combustion engine on the basis of said crank angle pulse signals and said cylinder identifying pulse signals, wherein said electronic control unit includes:

cylinder identifying means for discriminatively identifying each of said cylinders of said internal combustion engine by making use of said crank angle position based on said crank angle pulse signals and said cylinder identification information based on said cylinder identifying pulse signals;

crank angle signal period arithmetic means for arithmetically determining input periods of said crank angle pulse signals as crank angle pulse signal periods;

starter drive detecting means for detecting changeover of driving state of said starter;

rotation speed detecting means for detecting rotation speed of said internal combustion engine; and cylinder identification information invalidating means responsive to changeover of said starter driving state between driving state and non-driving state in an operation state in which said crank angle pulse signal period is longer than a predetermined period and in which rotation speed of said internal combustion engine is lower than a predetermined speed, for thereby invalidating the cylinder identification information detected before changeover of said starter driving state to inhibit said cylinder identification information from being employed in a succeeding cylinder identification.

2. A control apparatus for an internal combustion engine according to claim 1, wherein said cylinder identification information invalidating means is so designed that when the driving state of said starter is changed over, said crank angle pulse signals and said cylinder identifying pulse signals are inhibited from being employed for cylinder identification over a predetermined time period.

3. A control apparatus for an internal combustion engine according to claim 1, wherein said cylinder identifying means is so designed as to perform cylinder identification at a time point at which number of said crank angle pulse signals detected during a period intervening between two successive reference crank angle positions becomes coincident with a predetermined value after changeover of the driving state of said starter.

4. A control apparatus for an internal combustion engine according to claim 1, wherein said electronic control unit is so designed as to stop at least one of a fuel injection control and an ignition control for each of said cylinders of said internal combustion engine until condition for succeeding cylinder identification is satisfied after changeover of the driving state of said starter.

5. A control apparatus for an internal combustion engine according to claim 1, wherein said starter drive detecting means is so designed as to respond to a cranking switch signal for electrically energizing said starter.

6. A control apparatus for an internal combustion engine according to claim 1, wherein said starter drive detecting means is so designed as to respond to change of voltage of a battery.

* * * * *